United States Patent [19]

Adachi et al.

[11] 4,229,500

[45] Oct. 21, 1980

[54] POLYAMIDE MULTIFILAMENT YARN

[75] Inventors: Teruhiko Adachi; Hitoshi Ikeda, both of Mihara, Japan

[73] Assignee: Teijin Limited, Osaka, Japan

[21] Appl. No.: 866,542

[22] Filed: Jan. 3, 1978

[30] Foreign Application Priority Data

Jan. 13, 1977 [JP] Japan ..... 52-1870

[51] Int. Cl.[3] ..... D02G 3/00

[52] U.S. Cl. ..... 428/373; 264/210.3; 264/210.8; 528/323

[58] Field of Search ..... 264/210 F, 176 F, 210.3, 264/210.8; 528/323; 428/373

[56] References Cited

U.S. PATENT DOCUMENTS

| | | | |
|---|---|---|---|
| 2,957,747 | 10/1960 | Bowling | 264/210 F |
| 3,745,151 | 7/1973 | Takeda et al. | 264/210 F |
| 3,994,121 | 11/1976 | Adams | 264/210 F |
| 3,996,324 | 12/1976 | Landenberger et al. | 264/210 F |
| 4,019,311 | 4/1977 | Schippers | 264/210 F |
| 4,035,464 | 7/1977 | Kubitzek et al. | 264/210 F |
| 4,049,763 | 9/1977 | Migeo et al. | 264/176 F |
| 4,093,147 | 6/1978 | Bromley et al. | 264/210 F |
| 4,102,965 | 7/1978 | Kubitzek et al. | 264/290 N |

FOREIGN PATENT DOCUMENTS

| | | | |
|---|---|---|---|
| 42-2615 | 2/1967 | Japan | 264/168 |
| 48-17605 | 5/1973 | Japan . | |
| 48-34530 | 10/1973 | Japan | 264/103 |
| 50-71920 | 6/1975 | Japan | 264/210 Z |
| 50-94223 | 7/1975 | Japan | 264/210 Z |
| 51-60725 | 5/1976 | Japan | 264/210 F |
| 51-96521 | 8/1976 | Japan | 264/210 F |

*Primary Examiner*—Jay H. Woo

*Attorney, Agent, or Firm*—Burgess, Ryan and Wayne

[57] ABSTRACT

Disclosed is a polyamide multifilament yarn comprising a plurality of polycapramide multifilaments and having a high softness, a mild touch, a level-dyeing property and an excellent colorfastness to washing and laundering. The individual filaments in this yarn are characterized by a birefringence of 0.045 or more, a denier of 0.8 or less and a ratio of the X-ray diffraction intensity $I_{23}$ at an angle ($2\theta$) of 23.2 degrees to the X-ray diffraction intensity $I_{21}$ at a peak formed at an angle ($2\theta$) of approximately 21 degrees which ranges from 0.50 to 1.00. A process for producing the above-mentioned polyamide yarn is also disclosed.

8 Claims, 4 Drawing Figures

POLYAMIDE MULTIFILAMENT YARN

Figure 1:
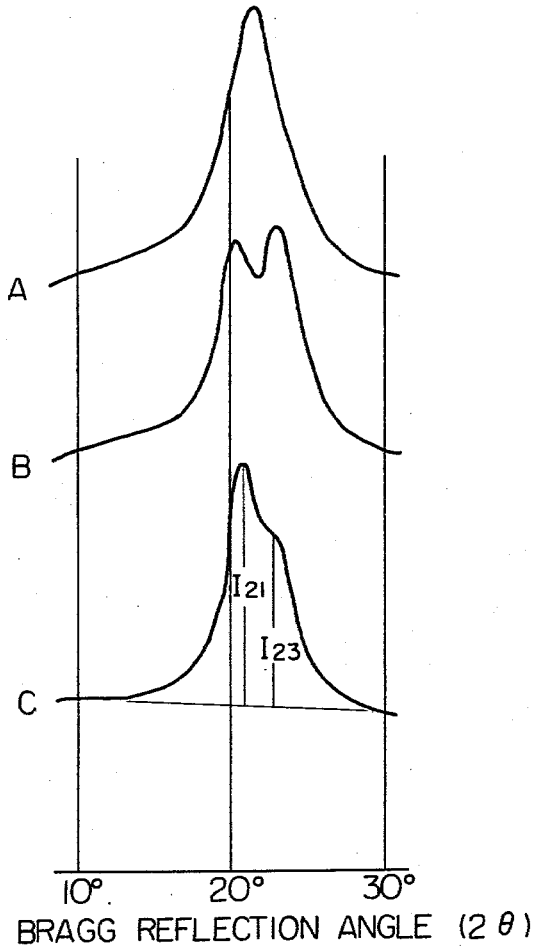

The present invention relates to a new type of polyamide multifilament yarn. More particularly, the present invention relates to a polycapramide multifilament yarn in which the individual filaments have a new internal microstructure.

Generally, the polyamide filaments can be classified into two groups. One of the groups consists of filaments having an $\alpha$-structure as the predominant crystalline structure thereof. The other group consists of filaments having a $\gamma$-structure as the predominant crystalline structure thereof. The $\alpha$-type polyamide filaments can be produced by melt-spinning a polyamide resin, taking up the resultant polyamide filaments at a speed of 1500 m/min or less, winding the taken-up filaments on a bobbin to form a filament package, and drawing the filaments in the package at a draw ratio of from 2.5 to 5.0. This method is known as the separate spinning-drawing method.

The $\gamma$-type polyamide filaments can be manufactured by melt-spinning a polyamide resin, taking up the resultant filaments at a speed of about 1000 m/min, and sequentially drawing the filaments at a draw ratio of from 3.0 to 5.0. This method is conventionally known as the continuous, spinning-drawing method. The $\gamma$-type polyamide filaments can also be produced by melt-spinning the polyamide resin and taking up the resultant filaments at a high speed of 3000 m/min or more. This method is conventionally known as the high speed spinning method.

The polyamide multifilament yarn consisting essentially of the $\alpha$-crystalline structure produced by the separate spinning-drawing method tends to be hard and a rigid, and tends to be unevenly dyed. However, this type of polyamide multifilament yarn has an excellent colorfastness to washing after the filament yarn is dyed.

Compared with this, the polyamide multifilament yarn consisting essentially of the $\gamma$-crystalline structure produced by the continuous spinning-drawing method or the high speed spinning method has an excellent softness and a mild touch, and tends to be uniformly dyed. However, this type of polyamide multifilament yarn has a relatively poor colorfastness to washing and laundering. The $\alpha$-type polyamide multifilament yarns are superior to the $\gamma$ type polyamide multifilament yarns in some properties and inferior in other properties.

The inventors of the present invention attempted to discover the basis from which the desirable properties of the polyamide multifilament are derived. Also, the inventors investigated ways to produce polyamide multifilaments having a high softness, a mild touch, a level-dyeing property and a high colorfastness to washing and laundering. As a result, the inventors found that the above-mentioned properties of the polyamide multifilaments can be attained when the $\alpha$-type crystalline structure is combined together with the $\gamma$-type crystalline structure in a proper proportion.

An object of the present invention is to provide a polyamide multifilament yarn having an excellent softness, a mild touch, a level-dyeing property and a colorfastness to washing and laundering, and also to provide a process for producing such a yarn.

Another object of the present invention is to provide a polyamide multifilament yarn which is suitable for producing a woven or knitted fabric therefrom, and also to provide a process for producing this type of yarn.

As will be described hereinafter, the above-mentioned objects can be attained for the polyamide multifilament yarns of the present invention by using the process of the present invention.

The polyamide multifilament yarn of the present invention comprises a plurality of polycapramide filaments characterized by the fact that each of the individual filaments in the yarn has a birefringence ($\Delta n$) of at least 0.045, a denier not greater than 0.8 and an X-ray diffraction intensity ratio satisfying the following relationship (I):

$$0.50 \leqq I_{23}/I_{21} \leqq 1.00 \qquad \text{(I)}$$

wherein $I_{23}$ represents an X-ray diffraction intensity at a Bragg reflection angle ($2\theta$) of 23.2 degrees and $I_{21}$ represents an X-ray diffraction intensity at a peak formed at a Bragg reflection angle ($2\theta$) of approximately 21 degrees.

The above-mentioned polyamide multifilament yarn can be produced by the process of the present invention which is characterized by the steps of:

(A) extruding a melt of polycapramide having an intrinsic viscosity [$\eta$] of from 0.7 to 1.3 determined in m-cresol at a temperature of 35° C., through a plurality of spinning orifices to form filamentary melt streams;

(B) solidifying the filamentary melt streams in a solidifying region located below the spinning orifices by bringing a cooling medium into contact with the filamentary melt streams;

(C) taking up the solidified filaments at a speed of at least 3000 m/min, after (a) drafting the melt-spun filaments at a draft ratio of from 100 to 2000, preferably, from 150 to 800, and (b) oiling the solidified filaments with an aqueous oiling liquid at a location of a distance L in meters below the spinning orifices, the distance L satisfying the following relationship (IV):

$$L \geqq 10.3 - 0.0039\,(S - 3000) - 11.4\,(1 - \sqrt{D}) \qquad \text{(IV)}$$

wherein S represents the taking up speed in meter/minute of the filaments and D represents the denier of the individual filament, while bundling the solidified filaments to form a multifilament yarn;

(D) relaxing the taken-up yarn to cause the yarn to shrink at a shrinkage of from 0.5 to 9.0%; and (E) winding up the relaxed yarn on a winding bobbin.

Figure 2:
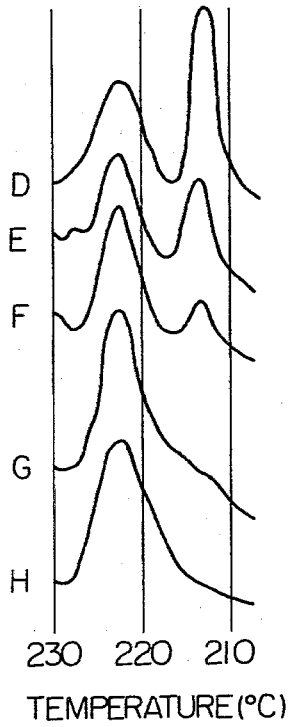
Figure 3:
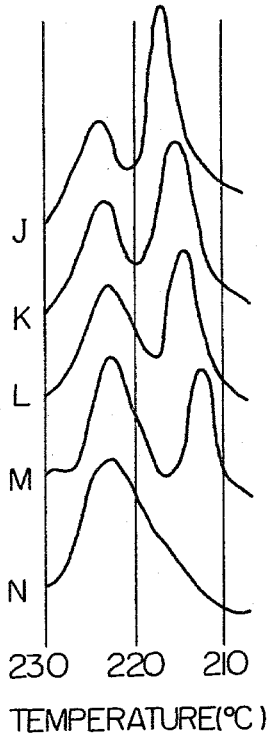
Figure 4:
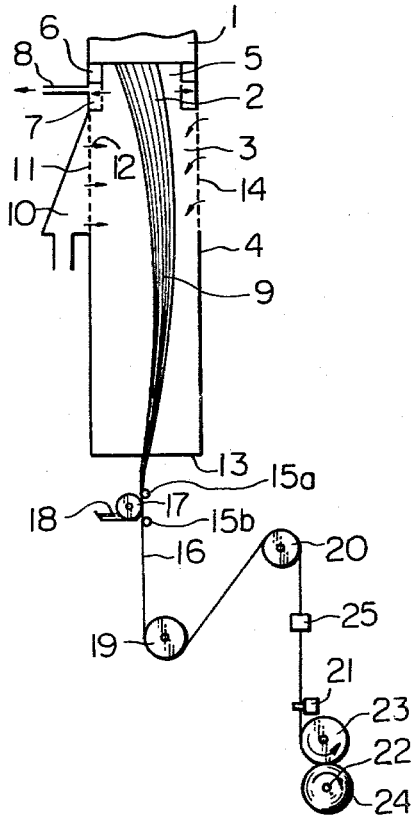

The features and advantages of the present invention will be apparent to persons aquainted with this type of multifilament yarn upon reading the following description with reference to accompanying drawings, in which:

FIG. 1 shows X-ray diffraction intensity curves of three different types of polycapramide filaments, FIG. 2 shows differential scanning calorimetric curves of five different types of polycapramide filaments, FIG. 3 shows another set of differential scanning calorimetric curves of five different types of polycapramide filaments, and FIG. 4 shows a diagrammatic representation of a preferred process for producing the polycapramide multifilament yarn of the present invention.

The polyamide yarn of the present invention comprises a plurality of preferably 40 or more polycapramide filaments. The polycapramide usable for the present invention can be either a caprolactam homopolymer (nylon 6) or a copolymer of 90% by weight or more of caprolactam and the balance consisting of one or more comonomers capable of forming a polyamide, as long as the copolymer is able to be formed into a multifilament yarn having the essential features of the present invention.

For example, the comonomer to be copolymerized with caprolactam may be selected from the following: hexamethyleneadipamide, hexamethylenesebacamide or hexamethyleneterephthalamide. The polycapramide may be a mixture of two or more of the above-mentioned homopolymer and copolymers. Furthermore, the polycapramide may be a mixture of a large amount of caprolactam homopolymer and a very small amount of polyhexamethyleneadipamide, polyethylene terephthalate or polybutylene terephthalate. The polycapramide multifilament yarn may contain a small amount of a delustering agent such as titanium dioxide, a coloring material, an antioxidant, a moisture-absorbing agent or a filler.

The polycapramide usable for the present invention has an intrinsic viscosity of from 0.7 to 1.3 determined in m-cresol at a temperature of 35° C.

The individual polycapramide filament in the yarn of the present invention has a birefringence ($\Delta n$) of at minimum 0.045, preferably from 0.047 to 0.055, and a denier of at maximum 0.8, preferably from 0.4 to 0.8. Since the polycapramide filament having a birefringence smaller than 0.045 has a poor degree of molecular orientation, the yarn composed of this type of polycapramide multifilaments has a poor colorfastness to washing and laundering and does not have with a tensile strength or a break elongation which is sufficient enough for various uses of the yarn.

The polycapramide individual filament having a denier larger than 0.8 cannot have a crystalline structure satisfying the specified X-ray diffraction intensity ratio mentioned above, a birefringence larger than 0.045, a high softness and a mild touch.

The polycapramide filaments have a special crystalline structure which is a combination of the $\alpha$-type and the $\gamma$-type crystalline structures in a proper proportion. This special crystalline structure can be represented by a specified X-ray diffraction intensity ratio $I_{23}/I_{21}$ of from 0.50 to 1.00. That is the X-ray diffraction intensity curve has a peak at an angle ($2\theta$) of approximately 21 degrees. The maximum diffraction intensity at an angle ($2\theta$) of approximately 21 degrees is represented by $I_{21}$. The diffraction intensity at $2\theta=23.2$ degrees is represented by $I_{23}$. In the polycapramide multifilaments of the present invention, the ratio $I_{23}/I_{21}$ is within a range of from 0.50 to 1.00.

The X-ray diffraction intensity curve of the polyamide multifilaments can be determined by using any conventional method. For example, in the present invention, the X-ray diffraction intensity curves were determined by the following method.

METHOD FOR DETERMINING X-RAY DIFFRACTION INTENSITY CURVE

1. Specimen for measurement

A number of polycapramide filaments were arranged parallel to each other to form a web having a width of 5 mm, a length of 25 mm and a thickness of from 0.2 to 1.0 mm. The web was impregnated with a bonding agent which is not reactive to the polycapramide filaments, and the bonding agent was hardened to form a rigid plate containing the polycapramide filaments. The plate was used to determine the crystalline structure of the polycapramide filaments.

2. The conditions for the measurement of the X-ray diffraction intensity curve were as follows:
   Testing apparatus: Model DC-9 (product of Rigaku Denki Kabushiki Kaisha)
   Source of X-rays: Cu-K $\alpha$-rays
   Power: 35 KV, 15 mA
   Filter: Nickel filter
   Divergence slit: 2 mm $\phi$
   Scattering slit: 1°
   Receiving slit: 0.3
3. The specimen was rotated on a plane perpendicular to the incident direction of the X-rays. The diffraction intensities at $2\theta=21$ degrees and 23.2 degrees were determined by tracing the diffraction of the X-rays in accordance with the transmission method.

Shown in FIG. 1 are three types of X-ray diffraction intensity curves of the polycapramide filaments which were determined in accordance with the above-mentioned method.

Referring to FIG. 1, Curve A represents a polycapramide filament which was produced by the conventional high speed spinning process. Curve A has a peak at $2\theta=21.5$ degrees. That is, the polycapramide filament represented by Curve A consists essentially of the $\gamma$-type crystalline structure. Curve B represents a polycapramide filament produced by the conventional separate spinning-drawing process. This curve has two peaks respectively formed at $2\theta=20$ degrees and at $2\theta=23.2$ degrees. That is the polycapramide filament of Curve B consists essentially of the $\alpha$-type crystalline structure. Curve C represents the polycapramide filaments of the present invention. This curve has a peak at an angle ($2\theta$) of approximately 21 degrees and a shoulder at $2\theta=23.2$ degrees. When the X-ray diffraction intensities at a peak formed at an angle ($2\theta$) of approximately 21 degrees and $2\theta=23.2$ degrees are represented by $I_{21}$ and $I_{23}$, respectively, the ratio $I_{23}/I_{21}$ can be used to represent a proportion of the content of the $\alpha$-type crystalline structure to the content of the $\gamma$-type crystalline structure in the polycapramide filaments. When the ratio $I_{23}/I_{21}$ is within a range of from 0.50 to 1.00, the proportion of the content of the $\alpha$-type crystalline structure to that of the $\gamma$-type crystalline structure is appropriate for obtaining the polycapramide multifilament yarns of the present invention. If the ratio $I_{23}/I_{21}$ is smaller than 0.5, that is, if the content of the $\gamma$-type crystalline structure in the polycapramide multifilaments is excessively high, the polycapramide multifilament yarn will have a poor colorfastness to washing and laundering. If the ratio $I_{23}/I_{21}$ is larger than 1.00, that is, if the content of the $\alpha$-type crystalline structure is excessively high, the polycapramide multifilament yarn will have a poor softness. Generally, the polycapramide filaments produced by the conventional separate spinning-drawing process have a large ratio $I_{23}/I_{21}$ of 1.05 or more. Also, the polycapramide filaments manufactured by the conventional high speed spinning process generally have a small ratio $I_{23}/I_{21}$ of less than 0.50.

The individual polycapramide filaments in the polyamide multifilament yarn of the present invention have only one endothermic peak at a temperature of 222°

C.±1° C. in the differential scanning calorimetric (DSC) curve thereof.

The DSC curve can be determined by the following method.

The polyamide filaments are cut to form short fibers having a length of 0.5 mm or less and then dried under vacuum at a temperature of 20° C. for about 24 hours. 5 mg of fibers are scanned by a differential scanning calorimeter (Model PERKIN-ELMER DSC-1B) at a scanning speed of 10° C./min.

FIG. 2 shows DSC Curves D through G of four different types of polycapramide filaments which respectively have deniers of 4.4 (Curve D), 2.9 (Curve E), 1.0 (Curve F) and 0.7 (Curve G) which were produced by the high speed spinning process at a take up speed of 3500 m/min and at a distance L of 6.7 m. FIG. 2 also shows the DSC Curve H of a polycapramide filament which has a denier of 2.9 and which was produced by the conventional separate spinning-drawing process.

FIG. 3 shows DSC Curves J through M of four different types of polycapramide filaments which have a denier of 2.9 and which were produced by the high speed spinning process respectively at take up speeds of 6000 m/min (Curve J), 5000 m/min (Curve K), 4000 m/min (Curve L) and 3500 m/min (Curve M). FIG. 3 also shows the DSC Curve N of a polycapramide filament which has a denier of 2.9 and which was produced by the conventional separate spinning-drawing process. The polycapramide filaments of Curves D, and E in FIG. 2 and the polycapramide filaments of Curves J, K, L and M in FIG. 3 respectively have a ratio $I_{23}/I_{21}$ of less than 0.5. Curves D to F and curves J to M each have two peaks at temperatures of around 215° C. and around 222° C. The polycapramide filaments of Curves H and N produced by the conventional separate spinning-drawing process each have a ratio $I_{23}/I_{21}$ of more than 1.00. The Curves H and N each have only one peak at a temperature of around 222° C. Compared with this, the polycapramide filament of Curve G of the present invention has a ratio $I_{23}/I_{21}$ falling within the range of from 0.5 to 1.00, and the Curve G has only one peak at a temperature of 222° C.±1° C.

Generally, the special polycapramide filaments of the present invention have a birefringence of 0.045 or more, a denier of 0.8 or less and the above-mentioned special crystalline structure has a tendency to shrink 13% or more in boilling water. In comparison, the conventional polycapramide filament produced by the separate spinning-drawing process has a relatively small shrinkage of 10% or less in boiling water.

The shrinkage of polycapramide filaments in boiling water is determined by the following method. An individual filament is stretched under a tension of 0.01 g/denier and marked at two locations spaced apart from each other at a predetermined distance $l_1$ (500 mm). After releasing the tension, the filament is immersed in boiling water for 30 minutes. Thereafter, the filament is taken up from the boiling water. Water on the filament is removed therefrom. The filament is dried. The dried filament is stretched under a tension of 0.01 g/denier, and the distance between the above-described locations is measured. This distance is represented by $l_2$. The shrinkage of the filament is determined in accordance with the following formula:

$$\text{Shrinkage (\%)} = \frac{l_1 - l_2}{l_1} \times 100$$

The polycapramide filament of the present invention has a relatively small Young's modulus of from 180 to 250 kg/mm$^2$ and a small denier of 0.8 or less. Accordingly, the polycapramide multifilament yarns of the present invention have excellent softness. In addition to the above-mentioned properties, the polycapramide filament of the present invention has a tensile strength of from 4.0 to 6.0 g/denier and a break elongation of from 25 to 55% which are about the same as those of the polycapramide filaments produced by the separate spinning-drawing process.

The polyamide yarn of the present invention is composed of preferably 40 or more individual polycapramide filaments, more preferably, 50 or more individual polycapramide filaments. The multifilament yarn of the present invention may be converted into staple fibers. The polyamide yarn of the present invention is not limited to a special total denier thereof. However, it is preferable that the total denier of the polyamide yarn of the present invention be within a range of from 30 to 200. The individual filaments in the polyamide yarns of the present invention are not restricted to a specially-shaped cross-sectional profile. That is, the cross-sectional profile may be either of a regular circular shape or of an irregular shape, for example, a trilobate, tetralobate, or hexalobate shape.

The polyamide multifilament yarn of the present invention may be interlaced by subjecting the yarn to the action of a turbulent air stream. In this case, it is preferable that the interlaced yarn has an interlace coherency factor of 0.1 to 40/m determined by the hook drop method of U.S. Pat. No. 2,985,995. The coherency factor is measured as follows.

One end of a specimen of an interlaced multifilament yarn having a length of from 100 to 120 cm is fixed on a testing stand; the other end of the yarn is weight down with a weight of 200 mg/denier. A hook having a weight of 60 mg/denier is inserted into the yarn at about the center point of the width of the upper portion of the yarn and allowed to be pulled down along the vertical axis of the filament due to gravity.

When the movement of the hook is stopped due to the interlacement of the individual filaments in the yarn after the hook has descended a certain distance, the hook is pulled out from the yarn and, then, inserted into the yarn at a location of 3 mm below the location from which the hook was pulled out, so as to allow the hook to descend due to gravity. The above-mentioned downward motion of the hook is allowed to occur for 20 times. The distance l in cm between the location of the yarn into which the hook is inserted in the first operation and the location of the yarn at which the hook is stopped in the twentieth operation is measured. The above-mentioned measurement of the distance l is carried out five times, and an average value of the measured values of l is determined and represented by the symbol x. The interlace coherency factor of the interlaced yarn is calculated in accordance with the following formula:

$$\text{Interlace Coherency Factor} = \frac{100}{\frac{x}{20}} = \frac{2000}{x}$$

The interlaced polyamide yarn of the present invention having an interlace coherency factor of 0.1 to 40/m has a good winding-up property, and therefore, can be wound into a stable yarn package without traverse miss. When the interlaced yarn has an interlace coherency factor of 15/m or more, preferably, 25/m or more, the yarn will not only have an excellent degree of processability during the warping, weaving and knitting processes, but also an improved degree of processability when a fabric made of the interlaced yarn is raised.

The interlace can be carried out by jetting pressurized air or steam toward the multifilament yarn. The utilization of superheated steam during the interlace is effective for improving the dyeing property of the multifilament yarn of the present invention.

In the polyamide yarn of the present invention, it is preferable that the polycapramide, from which the multifilaments in the yarn are formed, has amino radicals, which are located at the terminals of the polycapramide molecules, in an amount satisfying the following relationships (II) and (III):

$$0.01([NH_2] - 45) + 0.9(\sqrt{de} - 0.9) + 30(\Delta n - 0.042) \geqq 0.30 \quad \text{(II)}$$

and $$[NH_2] \leqq 73 \quad \text{(III)}$$

wherein $[NH_2]$ represents an amount, expressed in chemical equivalent value per $1\times10^6$ g of the polycapramide, of the terminal amino radicals in the polycapramide, do represents the denier of an individual polycapramide filament and $\Delta n$ represents the birefringence of an individual polycapramide filament. The above-mentioned type of polyamide yarn of the present invention has an excellent colorfastness to washing and laundering, a high resistance to yellowing of the yarn and a highly stable dye-absorbing property of the yarn.

The terminal amino radicals in the polycapramide can be determined by the following method.

An amount of 0.3 g of polycapramide multifilament yarn is heat-dissolved in 5 ml of m-cresol at a temperature of 50° C. for 6 minutes. The solution is diluted with 10 ml of methyl alcohol. A small amount of Thymol Blue is added as an indicator to the solution. The total amount of the terminal amino group of the polycapramide in the solution is determined by the titration of the solution with 0.01 N aqueous p-toluene sulfonic acid solution.

In the process of the present invention for producing the polyamide yarn, a polycapramide resin having an intrinsic viscosity ($\eta$) of from 0.7 to 1.3 determined in m-cresol at a temperature of 35° C. is melted and the melt is extruded through a plurality of spinning orifices to form a plurality of melt-spun filamentary streams of the polycapramide melt.

The melt-spun filamentary melt streams are solidified in a solidifying region located below the spinning orifice by bringing a cooling medium, usually, cooling air adjusted to a predetermined temperature, into contact with the filamentary melt streams, usually, at a controlled flow rate, to form solidified multifilaments.

The solidified multifilaments are taken up at a predetermined speed while drafting the multifilaments at a draft of from 100 to 2000, preferably from 150 to 800, oiling and bundling the multifilaments at a predetermined location to form a multifilament yarn.

The characteristic crystalline structure of the individual polycapramide filaments of the present invention can be obtained by adjusting the take-up speed S of the solidified, drafted multifilament yarn to 3000 m/min or more, by adjusting the denier D of the individual filaments in the taken-up yarn to 0.8 or less, and by oiling and bundling the solidified multifilaments at a location of a distance L in meters from the spinning orifice, the distance L satisfying the relationship (IV):

$$L \geqq 10.3 - 0.0039(S - 3000) - 11.4(1 - \sqrt{D}) \quad \text{(IV)}$$

Also, it is important that a multifilament yarn is finished with an aqueous oiling liquid before being taken up.

It should be noted that the characteristic crystalline structure of the individual filaments of the present invention cannot be obtained by using only the conventional high speed spinning process in which the take-up speed of the multifilament yarn is controlled to 3000 m/min or more, for example, from 3000 to 6000 m/min. This fact is illustrated in FIGS. 1 and 3 and will be illustrated in the examples mentioned hereinafter.

The taken-up multifilament yarn is relaxed so as to allow the yarn to shrink at a shrinkage of from 0.5 to 9.0%. The relaxed multifilament yarn is wound on a winding bobbin.

The process of the present invention can be carried out by using a melt-spinning apparatus, for example, the apparatus shown in FIG. 4.

Referring to FIG. 4, a melt of polycapramide is extruded through a plurality of spinning orifices (not shown in the drawing) of a spinneret 1 to form a plurality of filamentary melt streams 2.

In this extruding operation, it is preferable that the extending linear rate Y of the polycapramide melt satisfies the following relationship (V) or (VI):

when $0.25 \leqq D \leqq 0.75$, $$-15D + 15 \leqq Y \leqq -22.5D + 45 \quad \text{(V)}$$

or when $0.75 < D \leqq 0.8$, $$-3D + 6 \leqq Y \leqq -22.5D + 45 \quad \text{(VI)}$$

wherein D represents a denier of the taken-up individual filament.

The extruding linear rate is calculated by using the following formula:

$$\text{Extruding linear rate (m/min)} = \frac{Q(\text{m}^3/\text{min})}{\Sigma A(\text{m}^2)}$$

wherein Q represents a flow rate in $m^3$/min of the melt flowing through a plurality of spinning orifices, and A represents a total sum of the cross-sectional areas($m^2$) of the spinning orifices. When the total number of the spinning orifices used is represented by H, the inside diameters of the spinning orifices are all equal and each diameter is represented by d, the $\Sigma$ A can be calculated by using the following formula:

$$\Sigma A = \frac{\pi}{4} d^2 \times H$$

It is preferable that the inside diameter of the spinning orifices be in a range of from 0.1 to 0.3 mm for producing the polycapramide multifilament yarn according to the present invention.

The extruded filamentary melt streams are forwarded into a solidifying region 3 defined by a spinning chimney 4. In this case, it is preferable that the top portion 5 of the solidifying region 3 right below the spinning orifices (not shown) of the spinneret 1 be regulated to a temperature distribution satisfying the following relationship (VII) and (VIII):

when $0.5 \leqq X \leqq 3$, $$-X + 233 \geqq T \geqq -2X + 244 \quad \text{(VII)}$$

and when $3 < X \leqq 6$, $$-\frac{5}{3}X + 235 \geqq T \geqq -9X + 245 \quad \text{(VIII)}$$

wherein T represents a temperature in °C. of the solidifying region at the location of a distance X in cm below the spinning orifices.

The temperature control of the top portion of the solidifying region may be effected by using a heater 6 provided around the path of the extruded filamentary melt streams 2.

Usually, a small amount of vapor of capramide monomer sublimates from the extruded melt streams. Accordingly, it is preferable that the monomer vapor be withdrawn from the top portion 5 of the solidifying region 3 through a duct 7 and a withdrawing pipe 8 to the outside of the spinning chimney 4.

The extruded filamentary melt streams 2 are solidified in the solidifying region 3 and converted into multifilaments 9, by bringing a cooling medium, usually, cooling air into contact with the extruded filamentary melt streams 2. In this solidifying operation, it is preferable that the cooling air be blown perpendicularly to one side of the path of the multifilaments 9 and into the solidifying region 3 through one side of the solidifying region. For this purpose, the upper part of the spinning chimney 4 is connected to a duct 10 through a perforated plate or net 11 provided on one side of the spinning chimney 4. The cooling air is blown from the duct 10 through the perforated plate or net 11 in the direction shown by the arrows 12. The blown cooling air cools and solidifies the filamentary melt streams, travels together with the multifilaments which are traveling at a high speed, and then emerges from the spinning chimney 4 through the lower end 13 of the chimney. The movement of the multifilaments at a high speed creates accompanying air streams. Due to the generation of the accompanying air streams, the atmospheric air is naturally sucked into the solidifying region through the opposite side of the spinning chimney 4. The opposite side is defined by another perforated plate or net 14. It is preferable that the amount by volume of the air naturally sucked into the spinning chimney be within a range of from 0.3 to 1.0 time that of the blown cooling medium.

The cooling air may be blown into the spinning chimney at an average linear speed of from 0.1 to 0.6 m/sec. Also, it is preferable that the atmospheric air be naturally sucked into the chimney at an average linear speed of from 0.3 to 1.0 time that of the blown cooling air.

Referring to FIG. 4, the solidified multifilaments 9 are oiled between a pair of guides 15*a* and 15*b* by means of oiling roller 17 with an aqueous oiling liquid 18. The oiled yarn 16 is taken up by a first godet roller 19 at a predetermined speed. The taken-up yarn travels through a second godet roller 20 and a traverse guide 21, and is wound up on a bobbin 22 by means of a winding roller 23 to form a package 24.

The yarn 16 is relaxed either between the second godet roller 20 and the winding roller 23 or between the first godet roller 19 and the second godet roller 20.

The yarn may be interlaced between the oiling operation and the winding up operation by using, for example, a conventional interlacing jet 25. The interlacing jet 25 may be located, for example, either between the oiling roller 17 and the first godet roller 19, between the first and second godet rollers 19 and 20 or between the second godet roller 20 and the traverse guide 21, shown in FIG. 4.

The interlacing process is not limited to a special interlacing intensity. However, it is preferable that the interlaced multifilament yarn has an interlace coherency factor of 0.1 to 40 as determined by the hook drop method of U.S. Pat. No. 2,985,995.

The interlacing process may be effected by using a pressurized air jet or a superheated steam jet directed to the multifilament yarn. The superheated steam jet may be located at any of the locations between the oiling roller 17 and a traverse guide 21. However, in order to interlace the multifilament yarn under a proper tension it is preferable that the superheated steam jet be located between the oiling roller 17 and the first godet roller 19 or between the first godet roller 19 and the second godet roller 20. Furthermore, it is preferable that the superheated steam has a temperature ranging between 100° and 200° C., more preferably, between 160° and 190° C.

In the process of the present invention, the taken-up multifilament yarn may be drawn at a draw ratio of at maximum 1.3 before being subjected to the relaxing operation. The drawing can be carried out at an ambient temperature or at an elevated temperature preferably of from 160° to 185° C. For example, the drawing may be effected between the first godet roller 19 and the second godet roller 20.

The polyamide multifilament yarn of the present invention can be utilized to provide a woven or knitted fabric. Also, the multifilament yarn of the present invention can be textured, doubled or twisted with a different yarn or yarns. Furthermore, the multifilament yarn of the present invention can be dyed and, then, converted into a woven or knitted fabric.

The woven or knitted fabric comprising the multifilament yarn of the present invention has a high softness, a mild touch and a level-dyeing property. Also, the dyed woven or knitted fabric comprising the multifilament yarn of the present invention has an excellent colorfastness to washing and laundering.

Accordingly, when the woven or knitted fabric made of the multifilament yarn of the present invention is impregnated with an elastomer such as polyurethane and raised, the resultant raised fabric is a suede-like artificial leather. In this case, the smaller the denier of the individual filaments in the artificial leather, the more suede-like the appearence, touch and writing effect of the resultant artificial leather.

When the multifilament yarn of the present invention is used to weave a fabric having a high warp and weft density, the resultant woven fabric is useful as a typewriter ribbon or as a computer printer ribbon, because of the high ink-holding property and the high durability of the fabric. Also, the high density fabric made of the multifilament yarn of the present invention is useful in winter sportswear because of the high windbreaking property and the high softness of the fabric.

EXAMPLES 1 through 8 and COMPARATIVE EXAMPLES 1 through 14

In Example 1, polycapramide pellets having an intrinsic viscosity ($\theta$) of 1.02 determined in m-cresol at a temperature of 35° C. were melted in an extruder, and the melt was extruded through 96 spinning orifices at a temperature of 250° C. in a melt-spinning apparatus as shown in FIG. 4. The resultant filamentary melt streams were solidified in a spinning chimney having a length of 5.0 m by blowing cooling air controlled at a temperature of 30° C. and at a flow linear speed of 20 cm/seconds on the filamentary melt streams while the streams were drafted at a draft ratio of 238. The solidified multifilaments were oiled and bundled at a location 6.7 m below the spinning orifices. The oiling is carried out in such a manner that about 10% by weight of an aqueous emulsion of the oiling agent is applied to the yarn so that 1.0% of the oiling agent based on the weight of the multifilament yarn is retained on the multifilaments yarn. The oiled multifilament yarn was taken up at a taking-up velocity of 3500 m/min. The resultant yarn had a total denier of 70. Accordingly, each of the individual filaments in the taken-up yarn had a denier of 70/96=0.73. The yarn was relaxed to allow the yarn to shrink at a shrinkage of 5%. The yarn was also interlaced by the action of a turbulent air jet.

The resultant multifilament yarn was subjected to measurements of tensile strength, break elongation and Young's modulus in accordance with the method No. 6-5-1 of JIS L-1073-77; to measurement of shrinkage in boiling water in accordance with the method No. 6-12(1)-A of JIS 1073-77; and to measurements of the X-ray diffraction intensity curve, the DSC curve and the interlace coherency factor in accordance with the method mentioned hereinbefore.

Multifilament yarns prepared according to the above-described method were converted into a composite yarn composed of three multifilament yarns. A knitted fabric was prepared by using the composite yarn which has a total denier of 210.

The knitted fabric was dyed under the following conditions.

| Dyeing Conditions | |
|---|---|
| Dye: | Kayacyl Blue AGG (C.I. Acid Blue 40) |
| Amount: | 3.0% based on the weight of the fabric |
| Liquor ratio: | 1:50 |
| Auxiliary agent: | 1.0% of Migregal 2N (Trademark of an anionic surface active agent made by Nihon Senka, Japan) and 1.0% of acetic acid based on the weight of fabric |
| Temperature: | 98 to 100° C. |
| Time: | 45 minutes |

The dyed fabric was subjected to measurement of color-fastness to laundering in accordance with the method A-2 of JIS L-0844-73. The dyed fabric was also examined by using the naked eye to evaluate the color evenness thereof.

The results of the above-mentioned measurements are indicated in Table 1.

In Example 2, the same procedures as those mentioned in Example 1 were carried out, except that the number of the spinning orifices used was 56 and the total denier of the taken-up multifilament yarn was 40.

In Example 3, the same procedures as those mentioned in Example 2 were carried out, except that the taking-up speed was 3800 m/min.

In Example 4, the same procedures as those mentioned in Example were carried out, except that the take-up speed was 3000 m/min. and the taken-up multifilament yarn was drawn at a draw ratio of 1.1 at an ambient temperature.

In Example 5, the same procedures as those mentioned in Example 4 were performed, except that the draw ratio was 1.2.

In Example 6, procedures identical to those mentioned in Example 4 were conducted, except that the draw ratio was 1.3.

In Example 7, procedures identical to those mentioned in Example 6 were carried out, except that the drawing operation was effected at a temperature of 180° C.

In Example 8, procedures identical to those mentioned in Example 1 were carried out, except that the number of the spinning orifices used was 80, the total denier of the taken-up multifilament yarn was 40, and the taking-up speed was 3300 m/min.

In Comparative Example 1, the same procedures as those mentioned in Example 1 were carried out except that sixteen spinning orifices were used, the taking-up speed was 1000 m/min., and the taken-up multifilament yarn was wound up on a bobbin and, then, drawn at a draw ratio of 3.2 by using drawing pins at an ambient temperature to produce a multifilament yarn of 70 denier/16 filaments which was formed by a separate spinning-drawing process.

In Comparative Example 2, the same procedures as those mentioned in Comparative Example 1 were carried out, except that 24 spinning orifices were used and therefore, the resultant yarn was 70 denier/24 filaments.

In Comparative Example 3, the same procedures as those mentioned in Comparative Example 1 were carried out, except that 34 spinning orifices were used to produce a multifilament yarn of 40 denier/34 filaments.

In Comparative Examples 4, 5 and 6, the same procedures as those mentioned in Example 1 were carried out, except that the numbers of the spinning orifices used were 16 (Comparative Example 4), 24 (Comparative Example 5) and 34 (Comparative Example 6), respectively, the taking-up speed was 1000 m/min., and the taken-up multifilament yarn was immediately drawn at a draw ratio of 3.2 by using a heating roller at a temperature of 50° C.

In Comparative Examples 7 and 8, the same procedures as those mentioned in Example 1 were carried out, except that the number of the spinning orifices used was 24 and the taking-up speeds were 3500 m/min. (Comparative Example 7) and 6000 m/min. (Comparative Example 8), respectively.

In Comparative Examples 9 and 10, the same procedures as those mentioned in Example 1 were carried out, except that the number of the spinning orifices used was 16, the taking-up speeds were 3500 m/min. (Comparative Example 9) and 6000 m/min. (Comparative Example 10), respectively, and the resultant multifilament yarns were 70 denier/16 filaments.

In Comparative Example 11, the same procedures as those mentioned in Comparative Example 9 were carried out, except that the number of the spinning orifices used was 34, and the total denier of the resultant multifilament yarn was 40.

In Comparative Example 12, the same procedures as those mentioned in Example 1 were carrier out, except that the number of the spinning orifices used was 56 and the taking up speeds were each 3000 m/min; therefore, the resultant yarn was 40 denier/56 filaments.

In Comparative Example 13, the same procedures as those mentioned in Example 4 were carried out, except that no drawing operation was effected, and the taken-up filament yarn was heat-relaxed at a temperature of 180° C. at a shrinkage of 3%.

In Comparative Example 14, the same procedures as those mentioned in Example 3 were carried out, except that the solidified multifilaments were oiled at a location of 2.9 m below the spinning orifices and the taking-up speed was 3500 m/min.

In Comparative Example 15, the same procedures as those mentioned in Comparative Example 14 were repeated except that the taking-up speed was 3800 m/min.

TABLE 1

| ITEM | | YARN Comparative Example 1 | 2 | 3 | 4 | 5 | 6 | 7 | 8 | 9 | 10 | 11 |
|---|---|---|---|---|---|---|---|---|---|---|---|---|
| Process | Type | Separate spinning -drawing process | | | Continuous spinning -drawing process | | | High - speed spinning process | | | | |
| | Taking-up speed(m/min) | 1000 | 1000 | 1000 | 1000 | 1000 | 1000 | 3500 | 6000 | 3500 | 6000 | 3500 |
| | Distance L (m) | 6.7 | 6.7 | 6.7 | 6.7 | 6.7 | 6.7 | 6.7 | 6.7 | 6.7 | 6.7 | 6.7 |
| | Draft ratio | 82 | 123 | 113 | 82 | 123 | 113 | 440 | 440 | 293 | 293 | 394 |
| Yarn | Denier/ filament | 70/16 | 70/24 | 40/34 | 70/16 | 70/24 | 40/34 | 70/24 | 70/24 | 70/16 | 70/16 | 40/34 |
| Individual filament | | | | | | | | | | | | |
| Denier | | 4.38 | 2.92 | 1.18 | 4.38 | 2.92 | 1.18 | 2.92 | 2.92 | 4.38 | 4.38 | 1.18 |
| Tensile strength (g/d) | | 5.0 | 5.1 | 4.5 | 5.0 | 5.0 | 4.9 | 4.2 | 4.9 | 4.1 | 4.8 | 4.5 |
| Break elongation (%) | | 40 | 38 | 40 | 40 | 38 | 37 | 62 | 40 | 67 | 42 | 50 |
| Young's modulus(kg/mm$^2$) | | 250 | 260 | 240 | 250 | 250 | 250 | 150 | 200 | 135 | 185 | 185 |
| Ratio $I_{23}/I_{21}$ | | 1.10 | 1.12 | 1.15 | 0.45 | 0.47 | 0.47 | 0.41 | 0.41 | 0.39 | 0.40 | 0.50 |
| Orientation (%) | | 90 | 91 | 92 | 90 | 90 | 90 | 87 | 90 | 86 | 88 | 89 |
| $\Delta n$ ($\times 10^3$) | | 52.0 | 52.5 | 50.5 | 43.0 | 42.5 | 43.0 | 36.0 | 38.5 | 35.5 | 38.0 | 41.8 |
| Shrinkage (%) in boiling water | | 10.5 | 11.0 | 12.5 | 14.8 | 15.2 | 15.8 | 11.0 | 10.8 | 10.0 | 10.3 | 13.8 |
| Interlace coherency factor per meter | | 30 | 30 | 35 | 20 | 20 | 20 | 20 | 10 | 15 | 10 | 30 |
| Temperature of main peak in DSC curve | | 222 | 222 | 222 | 222 | 222 | 221 | 214 | 218 | 214 | 218 | 221 |
| Color evenness | | Ordinary | Ordinary | Ordinary | Ordinary | Ordinary | Ordinary | Excellent | Excellent | Excellent | Excellent | Excellent |
| Colorfastness to laundering (class) | Alteration in color | 4 | 3–4 | 3 | 3–4 | 3 | 2–3 | 2–3 | 2 | 3 | 2–3 | 2–3 |
| | Staining | 4 | 4 | 3–4 | 3–4 | 3 | 2–3 | 2–3 | 2–3 | 3–4 | 3–4 | 3 |
| [$NH_2$] | equivalent /$10^6$g polymer | 45 | 45 | 45 | 45 | 45 | 45 | 45 | 45 | 45 | 45 | 45 |

| ITEM | | YARN Comparative Example 1 | Comparative Example 12 | Example 2 | Example 3 | Example 4 | Example 5 | Example 6 | Example 7 | Comparative Example 13 | Example 8 | Comparative Example 14 | Comparative Example 15 |
|---|---|---|---|---|---|---|---|---|---|---|---|---|---|
| Process | Type | High - speed spinning process | | | | High speed spinning process with drawing | | | with heat-drawing | with heat-relaxing | High speed spinning process | | |
| | Taking-up speed(m/min) | 3500 | 3000 | 3500 | 3800 | 3000 | 3000 | 3000 | 3000 | 3000 | 3300 | 3500 | 3800 |
| | Distance L (m) | 6.7 | 6.7 | 6.7 | 6.7 | 6.7 | 6.7 | 6.7 | 6.7 | 6.7 | 6.7 | 2.9 | 2.9 |
| | Draft ratio | 238 | 238 | 238 | 238 | 238 | 238 | 238 | 238 | 238 | 339 | 238 | 238 |
| Yarn | Denier/ filament | 70/96 | 40/56 | 40/56 | 40/56 | 40/56 | 40/56 | 40/56 | 40/56 | 40/56 | 40/80 | 40/56 | 40/56 |
| Individual filament | | | | | | | | | | | | | |
| Denier | | 0.73 | 0.71 | 0.71 | 0.71 | 0.71 | 0.71 | 0.71 | 0.71 | 0.71 | 0.50 | 0.71 | 0.71 |
| Tensile strength (g/d) | | 5.0 | 4.3 | 4.9 | 5.0 | 4.6 | 4.9 | 5.2 | 5.8 | 4.3 | 4.9 | 3.8 | 4.8 |
| Break elongation (%) | | 40 | 46 | 42 | 37 | 44 | 39 | 29 | 29 | 48 | 33 | 57 | 45 |
| Young's modulus(kg/mm$^2$) | | 200 | 200 | 230 | 240 | 230 | 240 | 245 | 250 | 196 | 250 | 145 | 210 |
| Ratio $I_{23}/I_{21}$ | | 0.64 | 0.53 | 0.55 | 0.68 | 0.53 | 0.65 | 0.90 | 0.95 | 0.47 | 0.60 | 0.47 | 0.54 |
| Orientation (%) | | 87 | 88 | 88 | 88 | 88 | 88 | 88 | 89 | 89 | 90 | 87 | 89 |
| $\Delta n$ ($\times 10^3$) | | 51.0 | 42.0 | 47.5 | 49.5 | 48.0 | 49.0 | 50.0 | 52.0 | 45.0 | 51.0 | 36.0 | 44.0 |
| Shrinkage (%) in boiling water | | 16.2 | 15.2 | 16.0 | 17.1 | 16.0 | 16.2 | 16.9 | 8.6 | 8.2 | 17.1 | 11.0 | 15.0 |
| Interlace coherency factor per meter | | 20 | 30 | 30 | 30 | 30 | 30 | 30 | 30 | 30 | 25 | 20 | 20 |
| Temperature of main peak in DSC curve | | 221 | 221 | 221 | 221 | 221 | 221 | 221 | 221 | 222 | 221 | 214 | 221 |
| Color evenness | | Excel- | Excel- | Excel- | Excel- | Excel- | Excel- | Excel- | Excel- | Excel- | Excel- | Excel- | Excel- |

TABLE 1-continued

| | | | | | | | | | | | | | |
|---|---|---|---|---|---|---|---|---|---|---|---|---|---|
| | | lent | lent | lent | lent | lent | lent | lent | lent | lent | lent | lent | lent |
| Colorfastness to laundering (class) | Alteration in color | 3 | 2–3 | 3 | 3 | 3 | 3 | 3–4 | 3–4 | 2 | 3 | 2 | 2–3 |
| | Staining | 3–4 | 3 | 3–4 | 3–4 | 3 | 3–4 | 3–4 | 3–4 | 2 | 3 | 2 | 3 |
| [$NH_2$] | equivalent /$10^6$g polymer | 45 | 45 | 45 | 45 | 45 | 45 | 45 | 45 | 45 | 45 | 45 | 45 |

EXAMPLES 9 and 10

In Example 9, the procedures identical to those mentioned in Example 2 were carried out, except that, the oiled multifilament yarn was interlaced between the first godet roller and the second godet roller with superheated steam ejected at a temperature of 180° C. under a pressure of 3 kg/cm$^2$.

In Example 10, the procedures identical to those mentioned in Example 8 were carried out, except that the oiled multifilament yarn was interlaced under the same conditions as those mentioned above.

The results of the same measurements as those mentioned in Example 1 are indicated in Table 2.

TABLE 2

| ITEM | | YARN Example 9 | YARN Example 10 |
|---|---|---|---|
| Process | Type | High-speed spinning process | |
| | Taking-up speed(m/min) | 3500 | 3300 |
| | Distance L (m) | 6.7 | 6.7 |
| | Draft ratio | 238 | 238 |
| YARN | Denier/filament | 40/56 | 40/80 |
| Individual denier | | 0.71 | 0.50 |
| Tensile strength (g/d) | | 5.0 | 5.0 |
| Break elongation (%) | | 42 | 31 |
| Young's modulus (kg/mm$^2$) | | 250 | 250 |
| Ratio $I_{23}/I_{21}$ | | 0.70 | 0.75 |
| Orientation (%) | | 89 | 90 |
| $\Delta n$ ($\times 10^3$) | | 51 | 52 |
| Shrinkage (%) in boiling water | | 15.0 | 16.0 |
| Interlace coherency factor per meter | | 30 | 25 |
| Temperature of main peak in DSC curve | | 221 | 221 |
| Color evenness | | Excellent | Excellent |
| Colorfastness to laundering (class) | Alteration in color | 3–4 | 3–4 |
| | Staining | 4 | 3–4 |
| [$NH_2$] | equivalent/$10^6$ g polymer | 45 | 45 |

EXAMPLES 11 through 26

Eighteen types of polycapramide resins having an intrinsic viscosity [$\eta$] of from 1.03 to 1.04 were prepared by varying the amount of sebacic acid as a polymerization-inhibitor to be added to the polymerization system. The amount of the terminal amino radicals [$NH_2$] in the resultant polycapramides are shown in Table 2.

In each of Examples 11 through 22, the same procedures as those mentioned in Example 1 were carried out. However, the values for the taking-up speed, the number of the individual filaments making up the resultant multifilament yarn, and the total denier of the resultant multifilament yarn as shown in Table 2 were used instead of those of Example 1. The birefringence of the resultant filament was determined.

The resultant multifilament yarn was converted into a composite yarn consisting of three yarns. A knitted fabric was prepared from the composite yarns. The fabric was kept in a highly humid atmosphere for 5 days. The yellowing of the fabric was observed. The fabric was scoured and dyed under the following conditions.

| | |
|---|---|
| Scouring | |
| Scourol No. 400 (Trademark of a non-ionic surface active agent made by Kao Atlas) | 10g/l |
| Liquor ratio | 1:50 |
| Temperature | 70° C. |
| Time | 20 minutes |
| Dyeing | |
| Dye Kayacyl Blue AGG (C.I. Acid Blue 40) | 3% based on the weight of fabric |
| Auxiliary agent | |
| Migregal 2N | 1% based on the weight of fabric |
| Acetic acid | 0.2cc/l |
| Liquor ratio | 1:66 |
| Temperature | 100° C. |
| Time | 45 minutes |

The dyed fabric was tested for colorfastness to laundering.

In each of Examples 23 through 26, the same procedures as those mentioned in Example 11 were carried out, except that the taken-up yarn was immediately drawn at a draw ratio of 1.3. As seen from the results for these Examples indicated in Table 2, the polyamide multifilament yarns of Examples 17, 18, 21, 23, 24, 25 and 26 satisfy the relationships (II) and (III) and, therefore, have excellent colorfastness of closs 4 or higher.

TABLE 2

| Example No. | Yarn Total denier | Yarn Number of filaments | $\sqrt{de}$ | Taking up speed m/min | Draw ratio | $\Delta n$ ($\times 10^3$) | [$NH_2$] Equivalent /$10^6$g | Colorfastness (alteration in color) to laundering (class) | Yellowing |
|---|---|---|---|---|---|---|---|---|---|
| 11 | 40 | 80 | 0.71 | 3000 | — | 47 | 45 | 3 | none |
| 12 | 40 | 80 | 0.71 | 3000 | — | 47 | 56 | 3 | " |
| 13 | 40 | 80 | 0.71 | 3000 | — | 47 | 65 | 3–4 | " |
| 14 | 40 | 80 | 0.71 | 3000 | — | 47 | 72 | 3–4 | slight |
| 15 | 40 | 80 | 0.71 | 3300 | — | 51 | 45 | 3 | none |
| 16 | 40 | 80 | 0.71 | 3300 | — | 51 | 56 | 3–4 | " |

TABLE 2-continued

| Example No. | Yarn Total denier | Yarn Number of filaments | $\sqrt{de}$ | Taking up speed m/min | Draw ratio | Δ n (×10³) | [NH₂] Equivalent /10⁶g | Colorfastness (alteration in color) to laundering (class) | Yellowing |
|---|---|---|---|---|---|---|---|---|---|
| 17 | 40 | 80 | 0.71 | 3300 | — | 51 | 65 | 4 | " |
| 18 | 40 | 80 | 0.71 | 3300 | — | 51 | 72 | 4 | slight |
| 19 | 40 | 56 | 0.85 | 3500 | — | 47 | 45 | 3 | none |
| 20 | 40 | 56 | 0.85 | 3500 | — | 47 | 56 | 3–4 | " |
| 21 | 40 | 56 | 0.85 | 3500 | — | 47 | 65 | 4 | " |
| 22 | 40 | 56 | 0.85 | 3500 | — | 47 | 72 | 4 | slight |
| 23 | 40 | 56 | 0.85 | 3000 | 1.3 | 52 | 45 | 3–4 | none |
| 24 | 40 | 56 | 0.85 | 3000 | 1.3 | 52 | 56 | 4 | " |
| 25 | 40 | 56 | 0.85 | 3000 | 1.3 | 52 | 65 | 4–5 | " |
| 26 | 40 | 56 | 0.85 | 3000 | 1.3 | 52 | 72 | 5 | slight |

EXAMPLES 27 through 30 and COMPARATIVE EXAMPLES 16 and 17

In each of Examples 27 through 30 and Comparative Examples 16 and 17, a polycapramide resin having an intrinsic viscosity [η] of 1.02 was melted in an extruder, and the melt was extruded through a plurality of spinning orifices at the flow rate and the extruding linear speed indicated in Table 3 for each Example. The distance L was 6.7 m. The number of orifices and their inside diameters are shown in Table 3. The resultant multifilament yarn was taken up at the speed shown in Table 3 for each Example. The processability of the melt-spinning operation was examined. In each of Examples 27 through 30, the extruding operation satisfies the relationships (V) and (VI); therefore, the extruded multifilaments had an excellent processability of the melt-spinning operation.

The results for these Examples are shown in Table 3.

TABLE 3

| Example | Yarn Total denier | Spinning Orifices Number | Spinning Orifices Flow rate (g/min) | Spinning Orifices Inside diameter (mm) | Spinning Orifices Extruding linear speed (m/min) | Taking-up speed (m/min) | Processability |
|---|---|---|---|---|---|---|---|
| Comparative example | | | | | | | |
| 16 | 40 | 56 | 12.2 | 0.4 | 1.73 | 3000 | Slightly poor |
| 17 | 40 | 56 | 12.2 | 0.08 | 44.4 | 3000 | Slightly poor |
| Example | | | | | | | |
| 27 | 40 | 56 | 14.2 | 0.2 | 8.29 | 3500 | excellent |
| 28 | 40 | 56 | 14.2 | 0.15 | 14.73 | 3500 | " |
| 29 | 40 | 80 | 12.2 | 0.15 | 8.86 | 3000 | " |
| 30 | 40 | 80 | 12.2 | 0.10 | 19.90 | 3000 | " |

EXAMPLES 31 through 38

In Example 31, a polycapramide resin having an intrinsic viscosity [η] of 1.0 was melt-spun by using the same method as that mentioned in Example 1, except that the distance L(m) was 9 m, the number of spinning orifices was 56, the resultant multifilament yarn had a total denier of 40, and the taking up speed was 3000 m/min. However, the inside diameter of the spinning orifices was 0.15 mm and, the extruding linear speed of the melt was 12.63 m/min. In the solidifying region, the temperatures at locations of distances X below the spinning orifices were adjusted to those shown below.

| X (cm) | 0.5 | 1 | 2 | 3 | 4 | 5 | 6 |
|---|---|---|---|---|---|---|---|
| Temperature (°C.) | 230 | 228 | 227 | 225 | 222 | 220 | 218 |

The above temperature distribution is hereinafter referred to as the Temperature Distribution A. The Temperature Distribution A satisfies the relationships (VII) and (VIII).

During the melt-spinning process, the processability thereof was examined. Also, the resultant multifilament yarn was subjected to a yarn evenness test.

In Example 32, the same procedures as those mentioned in Example 31 were carried out, except that a temperature distributor in the solidifying region as shown below was used instead of the Temperature Distribution A.

| X (cm) | 0.5 | 1 | 2 | 3 | 4 | 5 | 6 |
|---|---|---|---|---|---|---|---|
| Temperature (°C.) | 221 | 218 | 211 | 203 | 197 | 189 | 182 |

The above temperature distribution is referred to as the Temperature Distribution B which does not satisfy the relationships (VII) and (VIII).

In Examples 33 and 34, the same procedures as those mentioned in Examples 31 and 32 were carried out, respectively, except that the distance L(m) was 6.7 m, the taking-up speed was 3500 m/min, and the extruding linear speed was 14.73 m/min.

In Examples 35 and 36, the same procedures as those mentioned in Examples 33 and 34 were carried out, respectively, except that the inside diameter of each of the spinning orifices was 0.10 mm, the number of the spinning orifices was 80 the taking-up speed was 3000 m/min, and the extruding linear speed was 19.90 m/min.

In Examples 37 and 38, the same procedures as those mentioned in Examples 35 and 36 were carried out, respectively, except that the taking up speed was 3500 m/min and the extruding linear speed was 23.2 m/min.

The results of Examples 31 through 38 are shown in Table 4.

TABLE 4

| Example No. | Yarn: Total denier (m/min) | Spinning Orifices: Number | Inside diameter (mm) | Extruding linear speed (m/min) | Taking-up speed (mm) | Temperature distribution | Processability | Yarn evenness (μ %) |
|---|---|---|---|---|---|---|---|---|
| 31 | 40 | 56 | 0.15 | 12.63 | 3000 | A | excellent | 1.5 |
| 32 | 40 | 56 | 0.15 | 12.63 | 3000 | B | good | 2.2 |
| 33 | 40 | 56 | 0.15 | 14.73 | 3500 | A | excellent | 1.5 |
| 34 | 40 | 56 | 0.15 | 14.73 | 3500 | B | good | 2.1 |
| 35 | 40 | 80 | 0.10 | 19.90 | 3000 | A | excellent | 1.6 |
| 36 | 40 | 80 | 0.10 | 19.90 | 3000 | B | good | 2.0 |
| 37 | 40 | 80 | 0.10 | 23.2 | 3500 | A | excellent | 1.5 |
| 38 | 40 | 80 | 0.10 | 23.2 | 3500 | B | good | 2.0 |

Table 4 shows that all of the Examples 31 through 38 exhibit a good processability and have a good yarn evenness. Table 4 also shows that the Temperature Distribution A contributes more to improvement of the yarn evenness than the Temperature Distribution B.

EXAMPLES 39 through 42

In each of Examples 39 through 42, the same procedures as those mentioned in Example 33 were carried out by using a melt-spinning apparatus as shown in FIG. 4. In this apparatus, the spinning chimney had a perforated plate with an effective length of 100 cm for flowing cooling air adjusted to a temperature up to 30° C. into the solidifying region at a linear speed of from 20 to 80 cm/sec. The spinning chimney also had another perforated plate with an effective length of 100 cm for automatically sucking atmospheric air into the solidifying region.

The ratio of the flow rate of the blown cooling air to the flow rate of the sucked atmospheric air was adjusted to a value shown in Table 5 by varying the flow rate of the blown cooling air.

The resultant multifilament yarn was subjected to a yarn evenness test. The results of Examples 39 to 42 are shown in Table 5.

TABLE 5

| Example No. | Linear speed of blown cooling air (m/sec) | Ratio of flow rate of blown cooling air to sucked atomospheric air | Yarn evenness (μ %) |
|---|---|---|---|
| 39 | 0.8 | 1/0.1 | 2.3 |
| 40 | 0.6 | 1/0.5 | 1.5 |
| 41 | 0.4 | 1/0.8 | 1.3 |
| 42 | 0.2 | 1/1.2 | 2.0 |

Table 5 shows that the resultant multifilament yarns of Examples 39 through 42 have a good yarn evenness. Especially, in the case where the ratio of the flow rate of the blown cooling air to the sucked atmospheric air is in a range of from 1/0.3 to 1/1, the resultant multifilament yarn has an excellent yarn evenness.

What we claim is:

1. A polyamide yarn which comprises a plurality of multifilaments consisting essentially of polycapramide, characterized in that the individual filaments in said yarn have a birefringence (Δn) of from 0.045 to 0.055, a denier from 0.4 to 0.8 and an X-ray diffraction intensity ratio satisfying the following relationship (I):

$$0.50 \leqq I_{23}/I_{21} \leqq 1.00 \quad \text{(I)}$$

wherein $I_{23}$ represents the X-ray diffraction intensity at a Bragg reflection angle (2θ) of 23.2 degrees and $I_{21}$ represents the X-ray diffraction intensity at a peak formed at a Bragg reflection angle (2θ) of around 21 degrees.

2. A polyamide yarn as claimed in claim 1, wherein said individual polycapramide filaments have only one endothermic peak at a temperature of 222° C. ±1° C. as measured by a scanning calorimeter.

3. A polyamide yarn as claimed in claim 1, wherein said individual polycapramide filaments have a shrinkage in boiling water of at least 13%.

4. A polyamide yarn as claimed in claim 1, wherein said individual polycapramide filaments have a Young's modulus of from 180 to 250 kg/mm$^2$.

5. A polyamide yarn as claimed in claim 1, wherein said individual polycapramide filaments have a tensile strength of from 4.0 to 6.0 g/denier and a break elongation of from 25 to 55%.

6. A polyamide yarn as claimed in claim 1, wherein said yarn consists of at least 40 individual polycapramide filaments.

7. A polyamide yarn as claimed in claim 6, wherein said individual polycapramide filaments are mutually interlaced at an interlace coherency factor of from 0.1 to 40 per meter of said yarn, as determined by the hook drop method of U.S. Pat. No. 2,985,995.

8. A polyamide yarn as claimed in claim 1, wherein said polycapramide has amino radicals, located at the terminals of the polycapramide molecules, in an amount satisfying the following relationships (II) and (III):

$$0.01([NH_2] - 45) + 0.9(\sqrt{de} - 0.9) + 30(\Delta n - 0.042) \geqq 0.30 \quad \text{(II)}$$

and $$[NH_2] \leqq 73 \quad \text{(III)}$$

wherein $[NH_2]$ represents a chemical equivalent value per $1 \times 10^6$ g of the polycapramide, of the terminal amino radicals in the polycapramide, de represents a denier of the individual filaments, and Δn represents a birefringence of the individual polycapramide filaments.

* * * * *

UNITED STATES PATENT AND TRADEMARK OFFICE

CERTIFICATE OF CORRECTION

PATENT NO. : 4,229,500

DATED : October 21, 1980

INVENTOR(S) : Teruhiko Adachi, et al

It is certified that error appears in the above—identified patent and that said Letters Patent is hereby corrected as shown below:

Column 10, line 62: "appearence" should be --appearance--.

Column 19, line 56 (Table 5): "atomospheric" should be --atmospheric--.

Signed and Sealed this

Seventh Day of April 1981

[SEAL]

*Attest:*

RENE D. TEGTMEYER

*Attesting Officer*

*Acting Commissioner of Patents and Trademarks*